US005257481A

United States Patent [19]

Reppas et al.

[11] Patent Number: 5,257,481

[45] Date of Patent: Nov. 2, 1993

[54] RETRACTABLE DOME

[75] Inventors: George S. Reppas, 1030 San Raymundo, Hillsborough, Calif. 94010; William D. Goryl, San Francisco, Calif.

[73] Assignee: George S. Reppas, Hillsborough, Calif.

[21] Appl. No.: 697,722

[22] Filed: May 3, 1991

Related U.S. Application Data

[63] Continuation of Ser. No. 302,301, Jan. 25, 1989, abandoned.

[51] Int. Cl.[5] ..... E04H 3/10

[52] U.S. Cl. ..... 52/6; 52/66

[58] Field of Search ..... 52/6, 66, 64, 80

[56] References Cited

U.S. PATENT DOCUMENTS

| | | | |
|---|---|---|---|
| 3,195,275 | 7/1965 | Praeger | 52/80 |
| 4,075,795 | 2/1978 | Thomas | 52/66 |
| 4,204,372 | 5/1980 | Agopyan | 52/64 |
| 4,676,033 | 6/1987 | Allen et al. . | |
| 4,682,449 | 7/1987 | Berger . | |
| 4,706,419 | 11/1987 | Adachi et al. . | |
| 4,716,691 | 1/1988 | Allen et al. | 52/6 |
| 4,716,693 | 1/1988 | Webster . | |
| 4,727,688 | 3/1988 | Kida et al. | 52/6 |
| 4,738,057 | 4/1988 | Logan | 52/6 |
| 4,751,800 | 6/1988 | Kida et al. . | |

FOREIGN PATENT DOCUMENTS

| | | | |
|---|---|---|---|
| 2444763 | 8/1980 | France | 52/66 |

*Primary Examiner*—Michael Safavi

*Attorney, Agent, or Firm*—Harness, Dickey & Pierce

[57] ABSTRACT

A retractable dome stadium or the like utilizing a plurality of generally lune-shaped dome panels mounted for movement between an open position in which they are stacked one above the other in superimposed relationship and a closed position in which they are disposed in a generally side-by-side relationship, and a mechanism for guiding and moving said panels between said open and closed positions. A method of operation is also disclosed.

60 Claims, 4 Drawing Sheets

RETRACTABLE DOME

This is a continuation of U.S. patent application Ser. No. 07/302,301, filed Jan. 25, 1989, now abandoned.

The present invention relates to domed stadiums and more particularly to a retractable dome structures.

The desirability of providing an arena or stadium which can be fully open to the sun and fresh air in times of good weather and yet can be closed or partially closed, in times of inclement weather or excessive wind, is widely recognized. To accomplish this goal is very difficult because of the massive size of such structures.

It is therefore an object of this invention to provide a relatively simple design for such a stadium which is capable of being fully open as well as fully closed, which utilizes conventional spaceframe technology, which does not require an excessive amount of land, and in which the panels that move are relatively small and lightweight, thereby simplifying the support and actuation thereof, as well as the speed of movement thereof.

Other advantages and features will become apparent from the following specification taken in connection with the accompanying drawings.

BRIEF DESCRIPTION OF THE DRAWING FIGURES

FIG. 8 is an enlarged fragmentary diagrammatic sectional view taken generally in the same plane as FIG. 3 and illustrating the manner in which the ends of the dome panels are supported and actuated, the panels being shown in their open stacked position;

DESCRIPTION OF THE PREFERRED EMBODIMENT

Figure 1:
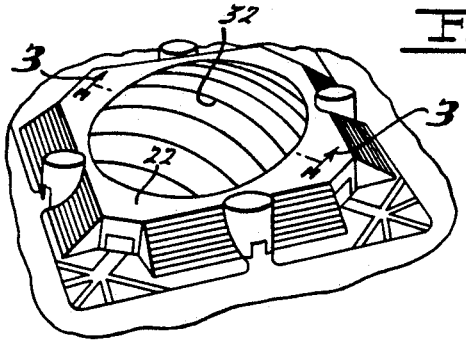
FIG. 1 is a pictoral view of a retractable dome stadium embodying the principles of the present invention, showing the dome in a closed position.

The present invention is applicable to virtually any type of stadium or the like, but for exemplary purposes is illustrated embodied in the athletic stadium of FIGS. 1–4. The stadium generally comprises an activity surface in the form of a playing area 10, a plurality of tiers of seating 12, seating boxes 14, parking levels 16, pedestrian ramp 18 and like features common to most stadiums.

Figure 2:
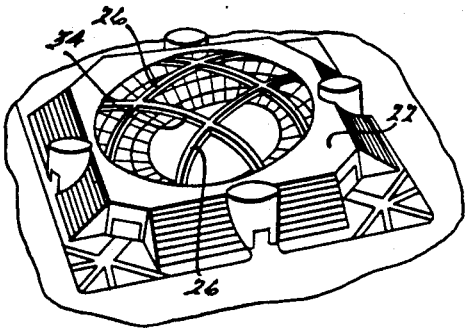
FIG. 2 is a view similar to FIG. 1 but showing the dome in an opening position.
Figure 4:
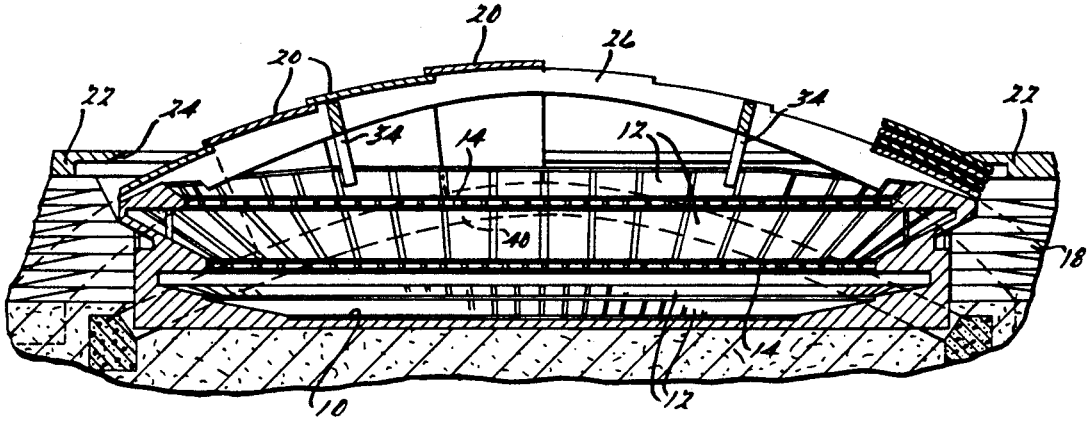
FIG. 4 is a view similar to FIG. 3 but taken at right angles thereto, the left portion of the figure showing the dome in its closed position and the right-hand portion of the figure showing the dome in its open position.

The present stadium is unique in that it can be fully opened and closed utilizing an improved retractable dome arrangement, generally comprising a plurality of generally equal width lune-shaped dome panels 20 movable between a closed position such as shown in FIGS. 1 and 4 (left side) in which the panels are disposed in side-by-side relationship to define a generally spherical segment shaped dome, and an open position such as shown in FIGS. 2 and 4 (right side) in which the panels are stacked one above the other. A lune is the surface of a sphere included between two great circles disposed at a given included angle of inclination. The dome of the present invention approximates a circular segment of a sphere and it is the shape of a truncated lune which is used for each of the movable dome panels. In a preferred embodiment of the present invention, the circular segment of the sphere defining the dome has an included angle of approximately 60 degrees and the included angle between the two great circles defining each lune-shaped panel is between 5 and 10 degrees. The top of the stadium complex is provided with a deck 22 defining a generally circular opening 24 disposed in close and slightly overlapping relationship with the outer ends of panels 20 in all positions thereof.

Figure 5:
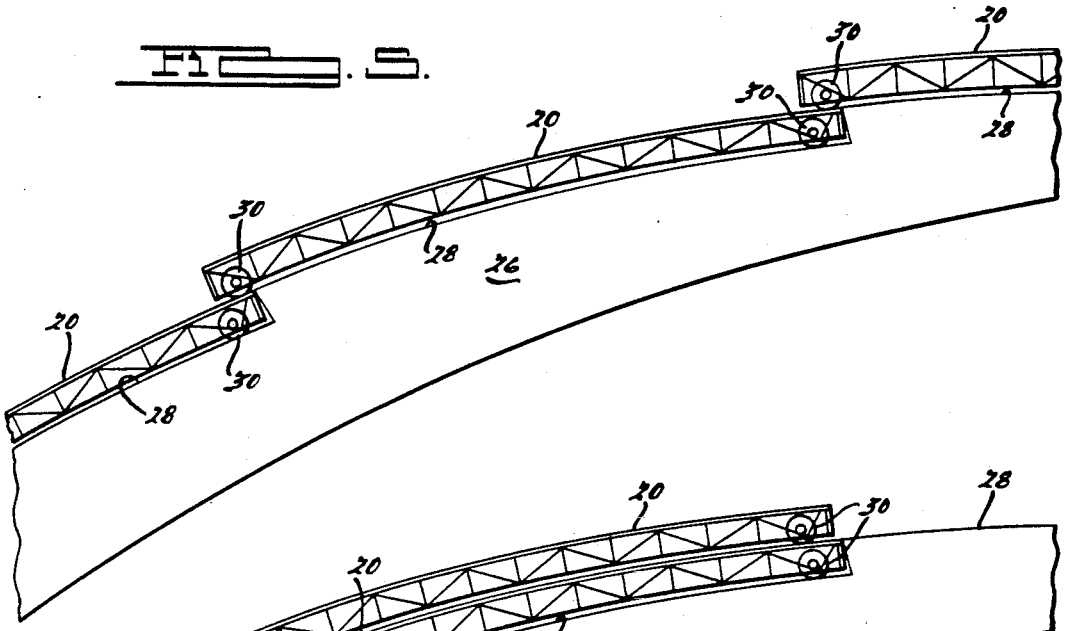
FIGS. 5, 6 and 7 are diagrammatic sectional views taken generally in the same plane as FIG. 4 and illustrating the sequence of movement of the dome panels from a closed to an open position.

Panels 20 are supported intermediate their ends by a pair of arcuate support rails 26 each having an upper surface having a plurality of arcuate steps 28, one for each panel 20 (FIG. 5–7), and which lie generally on a great circle of the imaginary sphere defined by the dome. The center of curvature of each step 28 is coincident with the center of the imaginary sphere with the radius of each step surface differing from the adjacent step surface by an amount approximately equal to the thickness of a panel 20. Each panel 20 has at least two supporting wheels 30 in alignment with each rail 26, and when the dome is closed each panel 20 is directly supported by rail 26 (FIG. 5) with the adjacent edges of panels 20 slightly overlapping one another to provide a weatherproof joint. The two centermost panels 20 abut one another at an interface 32 (FIG. 1) which can be provided with a suitable weatherproof seal. When panels 20 are moved downwardly and outwardly to the open position they roll from rail 26 onto the top surface (properly reinforced) of the next lower panel, and so on (FIG. 6–7) until they reach the nested or stacked condition shown at the right side of FIG. 4. Rails 26 are held in position by a suitable pair of arcuate supports 34, which can also be located on great circles of the imaginary sphere.

Figure 3:
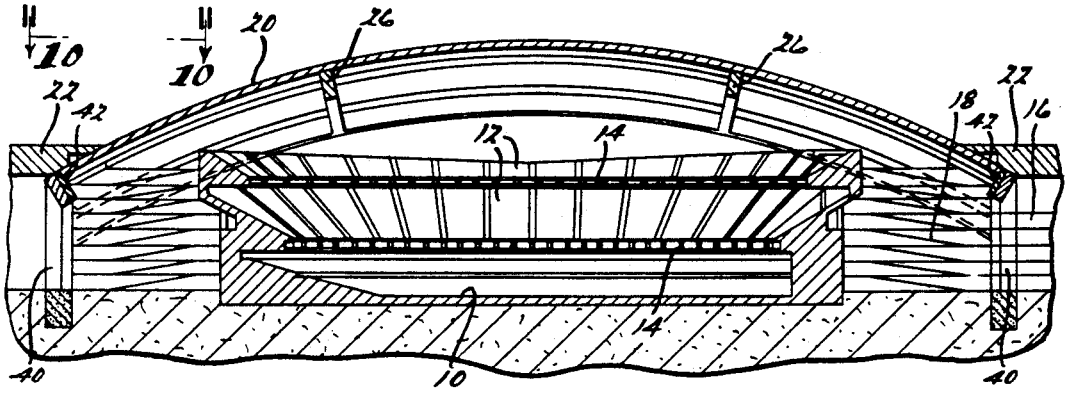
FIG. 3 is a transverse vertical sectional view taken generally along line 3—3 in FIG. 1.

Panels 20 are also supported on arcuate arches 40 disposed at each end thereof. Arches 40, illustrated generally in FIGS. 3 and 4, are substantially parallel to one another, being disposed in parallel vertical planes equally spaced from the center of the dome. The overall arc of each arch is the arc defined by the intersection of the vertical plane in which the arch lies and the imaginary sphere of the dome itself. Each arch 40 has a flat inclined arcuate surface 42 facing the ends of each panel 20 and being perpendicular to the longitudinal axis thereof. Surfaces 42 each lie on the plane of a great circle of the imaginary sphere of the dome, and each has on the face thereof a plurality of parallel arcuate slots 44 through which extend end supports 46 for each of the panels 20. Each support 46 extends for the full width of each panel 20 and is in turn supported on its lower surface by means of a plurality of rollers 48. Support 46 has upstanding outer flange 47 supported on opposite sides by a plurality of rollers 50 and 52 and at the upper edge of flange 47 is a rack 54 engaged by a pinion 56 driven by a plurality of motors 58. Slots 44, in plan, are arcs of a circle having the same center as the imaginary sphere of the dome, and are of a length to accommodate the maximum length of travel of the panel or panels (i.e., at opposite sides of the stadium) disposed therein. The motors 58 for each track are spaced apart a distance less than the length of rack 54 so that each panel will always be under the control of at least one motor. The same is true for the sets of rollers 48, 50 and 52.

Figures 9, 10:
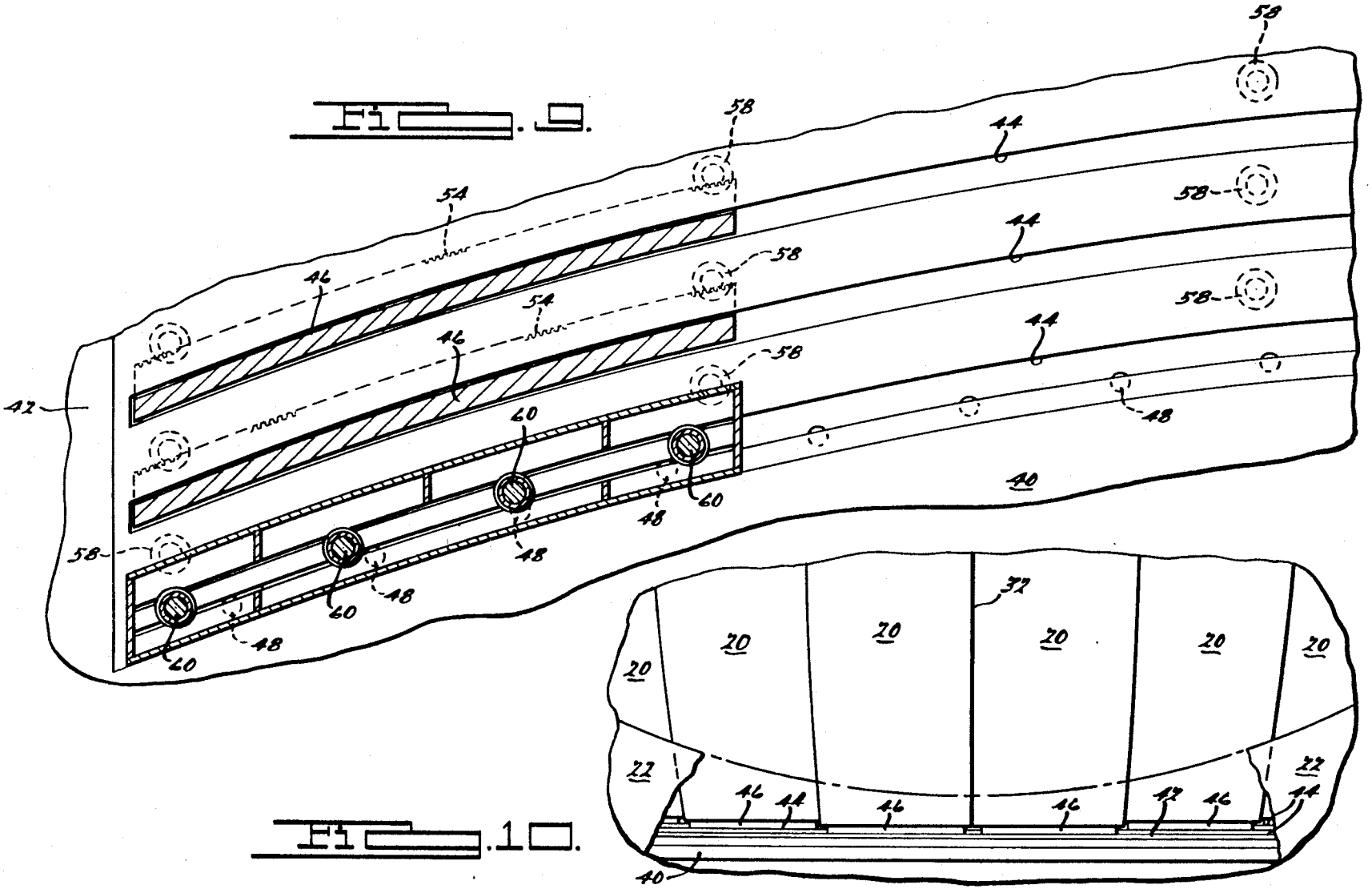
FIG. 9 is a fragmentary vertical sectional view taken generally along line 9—9 in FIG. 8.
FIG. 10 is a fragmentary view taken generally from line 10—10 in FIG. 3, with parts broken away.

As best seen in FIGS. 8 and 9, each support 46 has rigidly affixed thereto a plurality of rods 60 each slidably received within a cylindrical bore 62 at the free end of each panel 20. Each rod 60 extends generally in the direction of the longitudinal axis of the panel and the inner free end thereof is connected to a suitable shock absorbing and/or fluid-type compensating device 64 which is in turn affixed to panel 20. Device 64 can be of any desired construction and serves the purpose of dampening flopping movement of the panels under high wind conditions. They also can serve to compensate for thermal expansion and contraction of the entire structure.

Panels 20 may be of any desired lightweight construction, such as a standard spaceframe construction, with the outer panel skin being either fabric or metal, or a combination of both. The structural design of the panels, rails, arches, tracks, etc. can be in accordance with standard engineering and architectural practices based on the anticipated structural and weather loading.

Figure 6:
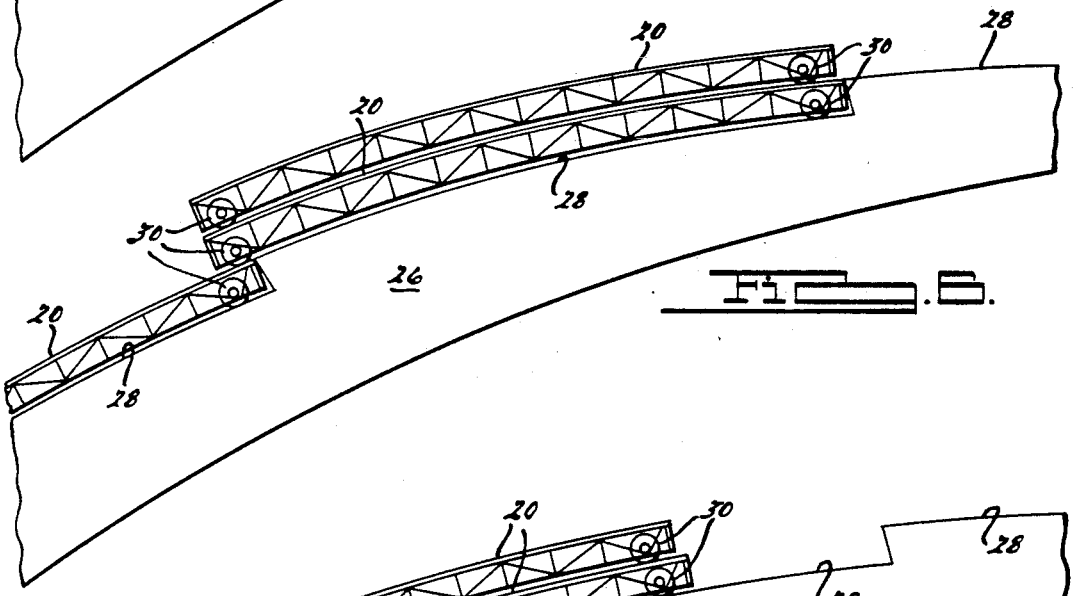
Figure 7:
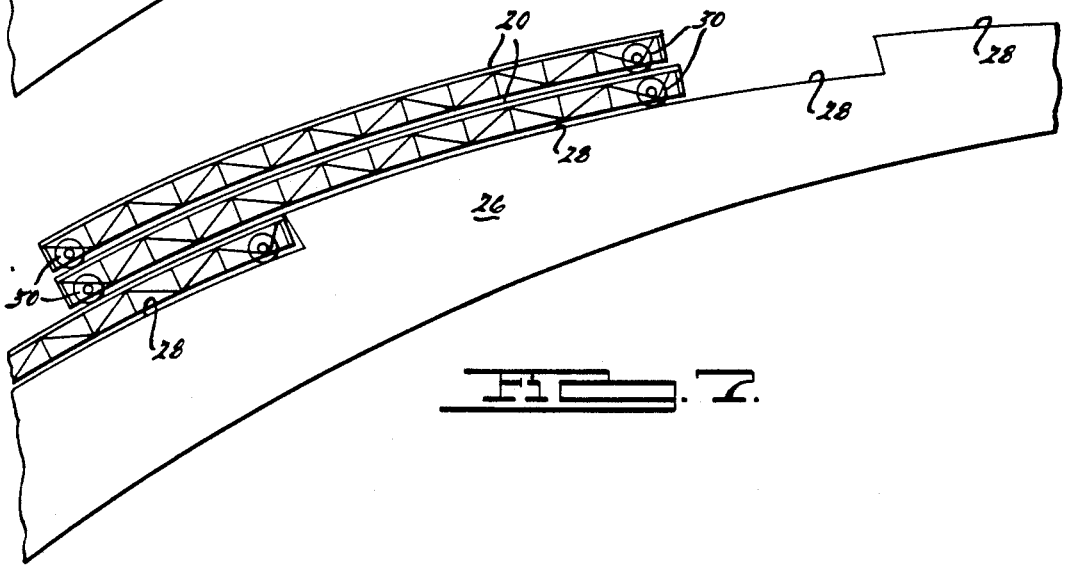
Figure 3:
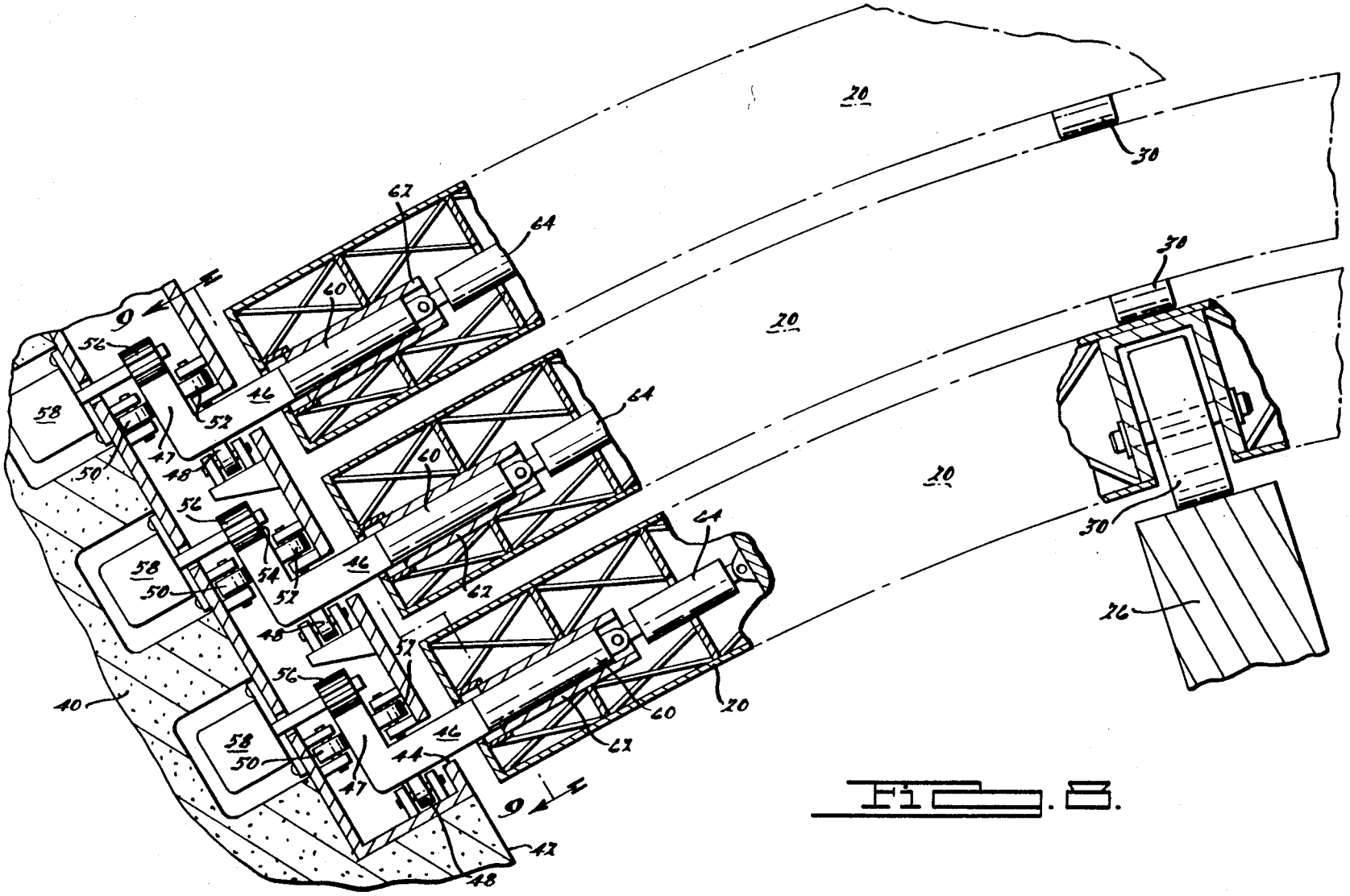

In operation, if the dome is closed it is opened by first actuating the motors in the top tracks which control the centermost panel to cause it to start retracting. As it retracts, it rolls over the top of the next centermost panel until they are fully stacked (FIG. 6). Thereafter, the motors for both these panels are actuated to cause them both to retract together (FIG. 7); and so on until the dome is fully opened, or at least opened to the desired extent. Both halves of the dome can be opened simultaneously if desired. The dome may be closed by simply reversing the opening sequence. Operating can be accomplished using conventional controls, sensors and the like.

While it will be apparent that the preferred embodiments of the invention disclosed are well calculated to provide the advantages above stated, it will be appreciated that the invention is susceptible to modification, variation and change without department from the proper scope or fair meaning of the subjoined claims.

It is claimed:

1. A retractable dome comprising:

(a) a plurality of lune-shaped dome panels, each panel extending to points on the opposite sides of the same transverse substantially vertical plane passing through the center of an imaginary sphere partially defined by the dome and mounted for movement between an open position in which they are stacked one above the other in superimposed relationship and a closed position in which they are disposed in a generally side-by-side relationship; and (b) means for moving said panels between said open and closed positions.

2. A retractable dome structure as claimed in claim 1 wherein a first plurality of said panels is disposed on one side of said dome and a second plurality of said panels is disposed on the opposite side of said dome.

3. A retractable dome as claimed in claim 2 wherein the centermost panels of said first and second pluralities of panels abut one another when all said panels are in said closed position.

4. A retractable dome as claimed in claim 3 further comprising a weatherproof seal disposed between said centermost panels.

5. A retractable dome as claimed in claim 2 wherein said dome generally approximates a spherical segment having an included angle of approximately 60 degrees when in the closed position.

6. A retractable dome as claimed in claim 1 wherein said panels partially overlap one another in said closed position to provide a substantially weatherproof connection.

7. A retractable dome as claimed in claim 1 wherein said panels are disposed in a generally concentric relationship in both said open and closed positions.

8. A retractable dome as claimed in claim 7 wherein said panels move with a generally pivotal-like motion between said positions, the axis of said motion extending generally through the center of an imaginary spherical segment defined by said panels when they are disposed in said closed position.

9. A retractable dome as claimed in claim 1 wherein each of said panels is of truncated lune shape.

10. A retractable dome as claimed in claim 9 wherein each said lune-shaped panel is symmetrically truncated to an included angle of approximately 60 degrees of great circle arc.

11. A retractable dome as claimed in claim 1 wherein the included angle between the two great circles defining each said lune-shaped panel is between five and ten degrees.

12. A retractable dome as claimed in claim 11 wherein said angle is approximately five degrees.

13. A retractable dome as claimed in claim 1 further comprising a base structure defining a pair of generally parallel arches, said panels being moveably supported on and being disposed between said arches.

14. A retractable dome as claimed in claim 13 wherein said arches are disposed generally at the intersection of two spaced parallel vertical planes and an imaginary sphere partially defined by said panels when they are disposed in said closed position.

15. A retractable dome as claimed in claim 14 wherein said vertical planes are equally spaced from the center of said imaginary sphere.

16. A retractable dome as claimed in claim 13 further comprising at least one track on each said arch for moveably supporting the ends of one of said panels.

17. A retractable dome as claimed in claim 16 wherein said one of said panels has a support member connected to the free end thereof, said support member having an outer free end supported by said track.

18. A retractable dome as claimed in claim 17 wherein said track comprises a set of rollers engaging and supporting said support member.

19. A retractable dome as claimed in claim 18 wherein there are a plurality of sets of said rollers, said sets being disposed substantially along the path of movement of the adjacent end of said one of said panels.

20. A retractable dome as claimed in claim 19 wherein said sets are spaced apart a distance less than the width of said one of said panels.

21. A retractable dome as claimed in claim 19 wherein said path is the arc of a circle having the same center as the center of an imaginary sphere partially defined by said panels when in said closed position.

22. A retractable dome as claimed in claim 21 wherein said path lies in the plane of a great circle of said imaginary sphere.

23. A retractable dome as claimed in claim 19 wherein each of said sets of rollers comprises a pair of rollers opposing one another and pinching said support members therebetween.

24. A retractable dome as claimed in claim 23 wherein said pinching is in a direction parallel to the longitudinal axis of said one of said panels.

25. A retractable dome as claimed in claim 19 wherein said support member has a transversely extending flange disposed at its outer free end.

26. A retractable dome as claimed in claim 25 wherein each of said sets of rollers comprises a pair of rollers opposing one another and pinching said flange therebetween.

27. A retractable dome as claimed in claim 17 wherein the inner free end of said support member is moveably affixed to said one of said panels.

28. A retractable dome as claimed in claim 27 wherein said support means can move with regard to said panel in a direction parallel to the longitudinal axis of said one of said panels.

29. A retractable dome as claimed in claim 28 further comprising means to dampen said longitudinal movement.

30. A retractable dome as claimed in claim 16 further comprising a separate track for each of said panels.

31. A retractable dome as claimed in claim 30 wherein said tracks generally lie in the same plane and are disposed parallel to one another.

32. A retractable dome as claimed in claim 31 wherein said panels are of substantially equal thickness and said tracks are spaced apart a distance just slightly greater than said thickness.

33. A retractable dome as claimed in claim 31 wherein said path is the arc of a circle having the same center as the center of an imaginary sphere partially defined by said panels when in said closed position.

34. A retractable dome as claimed in claim 1 wherein said panels are of lightweight spaceframe construction.

35. A retractable dome as claimed in claim 34 wherein said panels have a fabric skin.

36. A retractable dome as claimed in claim 34 wherein said panels have a metal skin.

37. A retractable dome as claimed in claim 1 wherein each of said panels is of substantially the same size and shape.

38. A retractable dome as claimed in claim 1 further comprising at least one generally arcuate rail disposed generally transversely to said panels for moveably supporting same intermediate the ends thereof.

39. A retractable dome as claimed in claim 38 wherein said rail has a plurality of steps on the upper surface thereof for supporting said panels, each step being of a length approximately equal to the width of the panel immediately supported thereby, taken along the line of intersection of said rail and panel.

40. A retractable dome as claimed in claim 39 wherein each said step is a generally circular cylindrical surface having a center coincident with the center of the imaginary sphere partially defined by said panels when in said closed position.

41. A retractable dome as claimed in claim 40 wherein said panels are of substantially equal thickness and said steps differ in radius by an amount approximately equal to said thickness.

42. A retractable dome as claimed in claim 40 wherein the depth of each said step is approximately equal to the thickness of the panel supported thereby when said panels are in said closed position.

43. A retractable dome as claimed in claim 39 further comprising at least one wheel on the bottom of each said panel adapted to rollingly engage the upper surface of said rail.

44. A retractable dome as claimed in claim 43 wherein said rail has a plurality of steps on the upper surface thereof for supporting said panels, each step being of a length approximately equal to the width of the panel immediately supported thereby, taken along the line of intersection of said rail and panel.

45. A retractable dome as claimed in claim 44 wherein the depth of each said step is approximately equal to the thickness of the panel supported thereby when said panels are in said closed position.

46. A retractable dome as claimed in claim 45 wherein said wheel rollingly engages the upper surface of the next outer panel when it moves toward said open position.

47. A retractable dome as claimed in claim 38 further comprising an arcuate support disposed transversely to said rail and being connected thereto for supporting same.

48. A retractable dome as claimed in claim 38 wherein there are a pair of said rails disposed generally parallel to one another.

49. A retractable dome as claimed in claim 48 further comprising a pair of generally parallel arcuate supports disposed transversely to said rails and being connected thereto for supporting same.

50. A retractable dome as claimed in claim 1 further comprising a substantially flat deck having a generally circular opening therethrough, said panels generally defining a segment of an imaginary sphere when in said closed position, said sphere extending upwardly through said opening, the ends of said panels extending outwardly beyond the periphery of said opening.

51. A retractable dome as claimed in claim 1 wherein the domed structure has a vertical center axis and wherein the panel on top of the stack in said open position is the panel disposed closest to the center axis of the domed structure when in said closed position.

52. A retractable dome as claimed in claim 1 wherein all of said panels are symmetrical about said vertical plane.

53. A retractable dome comprising:

(a) means defining an activity surface;

(b) a plurality of generally lune-shaped dome panels mounted for movement between an open position in which they are stacked one above the other in superimposed relationship and a closed position in which they are disposed in a generally side-by-side relationship, said panels overlying said activity surface when disposed in said closed position;

(c) a support member disposed on each free end of each of said panels, each said support member having an outer free end;

(d) a base structure defining a pair of generally parallel arches, said panels being movably supported on and being disposed between said arches;

(e) at least one track on each of said arches, each said track having a plurality of sets of rollers disposed thereon engaging and supporting one of said support members, each set of rollers comprising a pair of rollers opposing one another and pinching said one, of said support members therebetween and a third roller also engaging said one of said support members; and (f) means for moving said panels between said open and closed positions.

54. A retractable dome comprising:

(a) means defining an activity surface;

(b) a plurality of generally lune-shaped dome panels mounted for movement between an open position in which they are stacked one above the other in superimposed relationship and a closed position in which they are disposed in a generally side-by-side relationship, said panels overlying said activity surface when disposed in said closed position;

(c) a support member disposed on each free end of each of said panels, each said support member having an outer free end;

(d) a base structure defining a pair of generally parallel arches, said panels being moveably supported on and being disposed between said arches;

(e) at least one track on each of said arches, each said track having a plurality of sets of rollers disposed thereon engaging and supporting one of said support members, each set of rollers comprising a pair of rollers opposing one another and pinching said one of said support members therebetween and a third roller supporting one of said panels in a direction transverse to the plane of said one of said panels; and (f) means for moving said panels between said open and closed positions.

55. A retractable dome comprising:

(a) means defining an activity surface;

(b) a plurality of generally lune-shaped dome panels mounted for movement between an open position in which they are stacked one above the other in superimposed relationship and a closed position in which they are disposed in a generally side-by-side relationship, said panels overlying said activity surface when disposed in said closed position;

(c) a support member disposed on each free end of each of said panels, each said support member having an outer free end;

(d) a base structure defining a pair of generally parallel arches, said panels being moveably supported on and being disposed between said arches;

(e) at least one track on each of said arches, each said track having a plurality of sets of rollers disposed thereon engaging and supporting one of said support members, each set of rollers comprising a pair of rollers opposing one another and pinching said one of said support members therebetween and a third roller engaging the bottom surface of said one of said support members to support one of said panels in a direction transverse to the plane of said one of said panels; and (f) means for moving said panels between said open and closed positions.

56. A retractable dome comprising:

(a) means defining an activity surface;

(b) a plurality of generally lune-shaped dome panels mounted for movement between an open position in which they are stacked one above the other in superimposed relationship and a closed position in which they are disposed in a generally side-by-side relationship, said panels overlying said activity surface when disposed in said closed position;

(c) a support member disposed on each free end of each of said panels, each said support member having an outer free end and a transversely extending flange disposed on said outer free end;

(d) a base structure defining a pair of generally parallel arches, said panels being moveably supported on and being disposed between said arches;

(e) at least one track on each of said arches, each said track having a plurality of sets of rollers disposed thereon substantially along the path of movement of the adjacent end of one of said panels and engaging and supporting one of said support members, each of said sets of rollers comprising a pair of rollers opposing one another and pinching said flange therebetween and a third roller engaging said one of said support members in a direction overcoming the effect of gravity; and (f) means for moving said panels between said open and closed positions.

57. A retractable dome comprising:

(a) means defining an activity surface;

(b) a plurality of generally lune-shaped dome panels mounted for movement between an open position in which they are stacked one above the other in superimposed relationship and a closed position in which they are disposed in a generally side-by-side relationship, said panels overlying said activity surface when disposed in said closed position;

(c) a support member disposed on each free end of each of said panels, each said support member having an outer free end;

(d) a base structure defining a pair of generally parallel arches, said panels being movably supported on and disposed between said arches;

(e) at least one track on each of said arches for moveably supporting one of said outer free ends of one of said support members;

(f) means defining a gear rack in the vicinity of the outer free end of one of said support members, a pinion gear drivingly engaging said rack, and a motor for driving said pinion gear; and (g) means for moving said panels between said open and closed positions.

58. A retractable dome comprising:

(a) means defining an activity surface;

(b) a plurality of generally lune-shaped dome panels mounted for movement between an open position in which they are stacked one above the other in superimposed relationship and a closed position in which they are disposed in a generally side-by-side relationship, said panels overlying said activity surface when disposed in said closed position;

(c) a support member disposed on each free end of each of said panels, each said support member having an outer free end;

(d) a base structure defining a pair of generally parallel arches, said panels being movably supported on and disposed between said arches;

(e) at least one track on each of said arches for moveably supporting one of said outer free ends of one of said support members;

(f) means defining a gear rack in the vicinity of the outer free end of said one of said support members, a pinion gear drivingly engaging said rack, and a plurality of motors for driving said pinion gear, said motors being disposed substantially along the path of movement of the adjacent end of one of said panels; and (g) means for moving said panels between said open and closed positions.

59. A retractable dome comprising:

(a) means defining an activity surface;

(b) a plurality of generally lune-shaped dome panels mounted for movement between an open position in which they are stacked one above the other in superimposed relationship and a closed position in which they are disposed in a generally side-by-side relationship, said panels overlying said activity surface when disposed in said closed position;

(c) a support member disposed on each free end of each of said panels, each said support member having an outer free end;

(d) a base structure defining a pair of generally parallel arches, said panels being moveably supported on and disposed between said arches;

(e) at least one track on each of said arches for moveably supporting one of said outer free ends of one of said support members;

(f) means defining a gear rack in the vicinity of the outer free end of said one of said support members, a pinion gear drivingly engaging said rack, and a plurality of motors for driving said pinion gear, said motors being disposed substantially along the path of movement of the adjacent end of one of said panels and spaced apart a distance less than the width of said one of said panels; and (g) means for moving said panels between said open and closed positions.

60. A retractable dome comprising:

(a) means defining an activity surface;

(b) a plurality of generally lune-shaped dome panels mounted for movement between an open position in which they are stacked one above the other in superimposed relationship and a closed position in which they are disposed in a generally side-by-side relationship, said panels overlying said activity surface when disposed in said closed position;

(c) a support member disposed on each free end of each of said panels, each said support member having an outer free end;

(d) a base structure defining a pair of generally parallel arches, said panels being moveably supported on and disposed between said arches;

(e) at least one track on each of said arches for moveably supporting one of said outer free ends of said support members;

(f) means defining a gear rack in the vicinity of the outer free end of one of said support members, a pinion gear drivingly engaging said rack, and a plurality of motors for driving said pinion gear, said motors being disposed substantially along the path of movement of the adjacent end of one of said panels, said path being the arc of a circle having the same center as the center of an imaginary sphere partially defined by said panels when in said closed position; and (g) means for moving said panels between said open and closed positions.

* * * * *

UNITED STATES PATENT AND TRADEMARK OFFICE

CERTIFICATE OF CORRECTION

PATENT NO. : 5,257,481

DATED : November 2, 1993

INVENTOR(S) : George S. Reppas; William D. Goryl

It is certified that error appears in the above-indentified patent and that said Letters Patent is hereby corrected as shown below:

Column 1, line 62, "ramp" should be -- ramps --.

Column 6, line 66, after "one" delete -- , --.

Signed and Sealed this

Twenty-second Day of November, 1994

*Attest:*

Bruce Lehman

BRUCE LEHMAN

*Attesting Officer*

*Commissioner of Patents and Trademarks*